United States Patent [19]

Brown

[11] 4,222,388

[45] Sep. 16, 1980

[54] FEMININE BRASSIERE CUP FUR LINING

[75] Inventor: August R. Brown, Windsor, Colo.

[73] Assignee: Koshear, Inc., Greeley, Colo.

[21] Appl. No.: 935,574

[22] Filed: Aug. 21, 1978

[51] Int. Cl.[2] ..... A41C 3/10

[52] U.S. Cl. ..... 128/479; 2/65

[58] Field of Search ..... 128/479, 485, 425, 517, 128/516; 2/65, 66; 128/480, 482–484, 425

[56] References Cited

U.S. PATENT DOCUMENTS

| | | | |
|---|---|---|---|
| 2,021,906 | 11/1935 | Whitaker | 128/516 |
| 2,419,514 | 4/1947 | Wolf | 128/516 |
| 2,523,395 | 9/1950 | Sellarole | 128/516 |
| 2,535,059 | 12/1950 | Gluckin | 128/516 |
| 2,908,275 | 10/1959 | May | 128/425 |
| 3,400,720 | 9/1968 | Wark | 128/485 |
| 4,073,299 | 2/1978 | Murata | 128/425 |

OTHER PUBLICATIONS

McCalls, May 1946, p. 47.

*Primary Examiner*—Werner H. Schroeder
*Assistant Examiner*—Doris L. Troutman
*Attorney, Agent, or Firm*—Wilbur A. E. Mitchell

[57] ABSTRACT

Individual fur-like lining cup inserts for each cup of a feminine brassiere garment having breast supporting cups and adapted for loose insert within each brassiere cup, and for pressure holding therein on brassiere with cup insert lining wearing. Another embodiment of such individual fur lining cups each having a central opening, whereby on such brassiere cup lining insert brassiere wearing the feminine breast nipple will extend within its lining opening and act as lining cup center-holding means for holding its cup lining centered within the brassiere cup.

5 Claims, 6 Drawing Figures

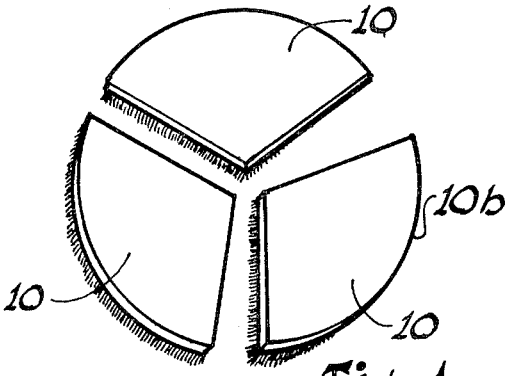
Fig. 1
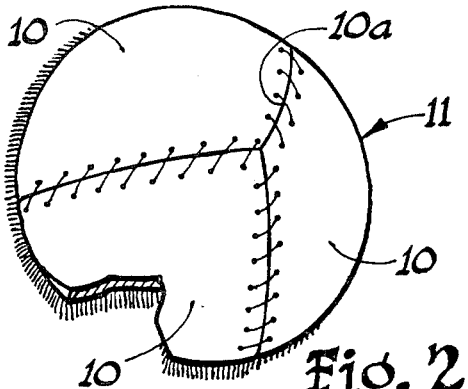
Fig. 2
Fig. 3
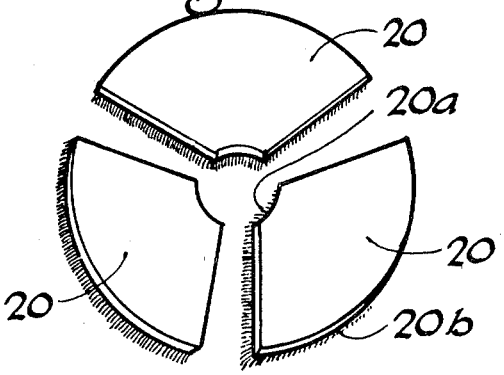
Fig. 5
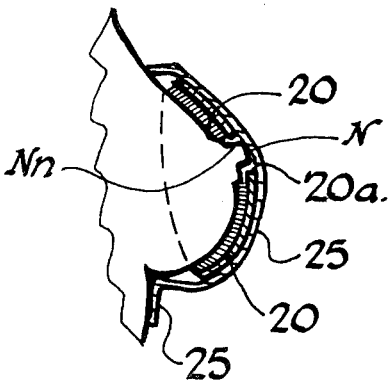
Fig. 4
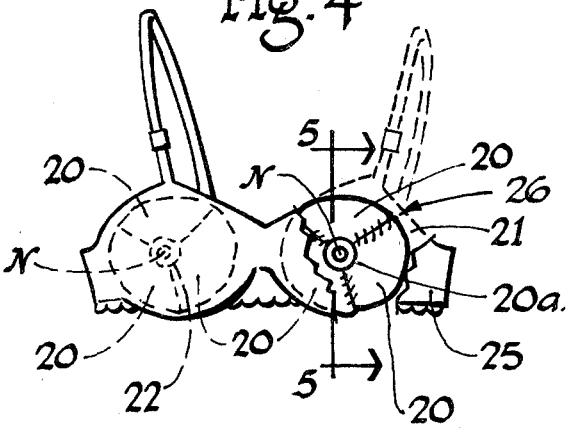
Fig. 6
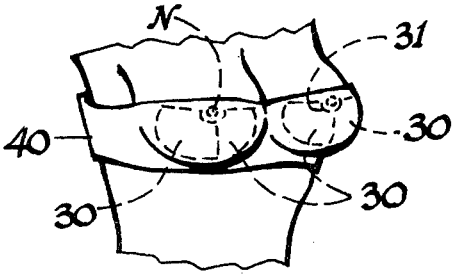

FEMININE BRASSIERE CUP FUR LINING

SUMMARY OF THE INVENTION

According to the invention, individual loose insert fur lining cups, each made with the fur side inwardly, are provided for insert within each cup of a feminine brassiere. A modification shows the individual fur lining cup as having a central opening, adapted to receive the feminine breast nipple therein. Said nipple in that modification also acts as a holding means for assisting in the holding of the individual inner fur lining within the breast supporting cup.

This invention relates to a feminine brassiere article of clothing. As far as understood, such a brassiere is usually constructed as a harness of conventional cloth-like material with breast holding cups or pockets, an adjustable body encircling strap, and over-shoulder adjustable supporting straps.

More particularly, this invention relates to providing fur-like individual unattached insert cup linings for each brassiere supporting cup.

In the course of the preparation of this application, Applicant's Attorney had a cursory preliminary search made by a Searcher in the Examiners' Search Room in Class 128, Subclass 516 and 517 then only of Applicant's first herein shown modification of FIGS. 1 and 2, and he selected the following U.S. Pat. Nos. as being most material to that modification of this invention:

2,021,906
2,419,514
2,523,395
2,535,059
2,908,275
3,400,720
4,073,299

The non relevance of above patents is believed to be evident. Copies of these patents are enclosed.

It is believed that Applicant's invention defined in his claims of this application constitutes an advance in the art which should be granted patent protection. Early and favorable action is respectfully requested.

So far as known, most brassieres do not usually have any lining within the breast supporting cups, and when same is provided, such lining forms undesirable ridges and is uncomfortable to the feminine wearer.

This invention provides individual soft fur-like lining cups for loose insert wearing in each conventional breast supporting cup of the brassiere, formed without lining ridge seams and adapted to be pressure held in place within each breast supporting cup thereof with the cup formed with its fur side inwardly for breast contact therewith upon brassiere pressure wearing.

I preferably make my individual brassiere fur lining cups for each conventional brassiere supporting cups of natural wild beaver cured fur. That fur is first conventionally tanned and the fur coarse guard hairs extracted, leaving a massive under-fur. That under-fur has a massive abundance of soft hairs normally extending about $\frac{1}{2}$ inch from its hide, and after the curing of that fur hide, I trim the fur hairs of even extended length of about $\frac{3}{8}$ inch or less, as desired, to form an ultra smooth soft hair surface. I then cut the cured hide preferably into three equal arc circular elliptical segments, each of about 110° outer edge periphery measurement, as illustrated in my FIG. 1. That outer edge is usually a preferable arc curvature, though there could be other designs or shape of that edge.

In my first preferred embodiment, shown in FIGS. 1 and 2, I butt sew the chord-radius or inner edges of the segments together, and thereby avoid making ridges juncture edges, and to thus form a resultant cone or cup-like individual cup lining unit, as shown in FIG. 2, with the fur side inwardly and the hide outwardly. Such fur lining cup is used by loosely unattachedly inserting it in a brassiere cup, with the lining hide side thereof toward the inside of the brassiere cup, to be held therein as hereinafter explained upon brassiere garment wearing use, by breast pressure.

In another preferred embodiment of my fur-like unattached brassiere lining cup, I cut away the apex or center points of each of the individual segments of the fur hide preferably before butt sewing assembly, to form a cup brassiere lining, with a small opening in the center of the individual cup lining, as shown in my FIGS. 3, 4 and 5. The breast nipple, on feminine wear, extends within that opening of the cup lining, thereby permitting the breast nipple to act as lining center-holding means within the brassiere cup.

The principal object of my invention is to provide a fur-like lining cup for a brassiere breast cup with the fur soft side of the lining toward the feminine breast when used, and adapted to be pressure held in place within a brassiere breast supporting cup on feminine wearing of the brassiere.

Another object of this invention is to provide such an individual cup lining for each brassiere breast supporting cup and with each fur lining having a central opening adapted to permit a feminine breast nipple to extend therein upon brassiere feminine wear use, whereby a feminine breast nipple, so extending within each lining opening, comprises center-holding means for such cup lining upon brassiere wear use with said cups therein.

Other objects will be apparent from the following detailed explanation and claims and from the drawing, in which:

BRIEF DESCRIPTION OF THE DRAWING

FIG. 1 illustrates beaver fur cut into separate segments before sewing them together to form my novel individual inner brassiere fur cup lining.

FIG. 2 is a perspective view illustrating a fur cup lining formed by segments of FIG. 1 being butt sewed together, with the hide outer-most and the fur side inner-most.

FIG. 3 illustrates similar segments of fur with the inner apex ends of each segment cut off concave a short distance, so that when the segments are sewed together a similar cup lining is formed but with an opening formed in the apex center thereof.

FIG. 4 diagrammatically illustrates in full view a feminine brassiere undergarment, as normally worn with shoulder straps and secured on the feminine body, with my novel inner lining fur cups of FIG. 3 in each breast supporting cup thereof.

FIG. 5 is a diagrammatic cross sectional view taken on the line 5—5 of FIG. 4 of the illustration looking in the direction of the arrows; and FIG. 6 is a diagrammatic illustration of a feminine breast wearing a plunge-type brassiere without shoulder straps and having another modification of my individual fur cup linings unattachedly within each breast supporting cup thereof.

DETAILED DESCRIPTION OF THE INVENTION

While I preferably use beaver fur to make my individual brassiere cup linings, it is to be understood that an artificial man-made fur-like cloth, having a smooth fur-like side extending from a hide-like surface, could be used with the fur-like side of about ¼ to ⅜ inches extension from the hide-like surface, so that upon feminine breast pressure contact with that fur-like hide a smooth surface will be present in non-irritational contact with the feminine breast. Also mouton fur-like lamb's hide fur could be used in place of beaver fur.

As explained, I make a first preferred embodiment of my fur cup inner unattached lining for each breast supporting cup of a brassiere by cutting cured beaver fur into three equal arc approximate 110° segments of a circle. Then I butt sew the radius-like edges 10*a* of those segments together to form a suitable size cup-like individual fur lining for each brassiere cup, with each fur cup adapted to be unattachedly inserted within a breast supporting cup of a brasssiere. Upon use of the brassiere by the feminine user, of the type as illustrated in FIG. 4 with shoulder straps and body circumferential strap and on securement of the body strap with my lining cups first positioned therein, each individual fur cup lining is pressure held within its brassiere breast supporting cup by the resistance of the feminine breast against the inner side of the fur lining cup in the brassiere cup, caused by the pressure of the brassiere by its body strap 25.

Thus, my novel loose fur-lined cup, on wearing within each breast supporting brassiere cup, overcomes the heretofore objection of friction caused by heretofore attached cloth-like inner lining in the breast supporting cups, and also the objection of ridge seams formed in such cloth inner lining. My fur inner cup lining has a fur soft hair surface extension inwardly of my lining cup, and it has no inner ridge seams as the segments are butt sewed together and my fur hairs are of sufficient length to cushion any threads joining that butt assembly, as shown in FIG. 2.

It will be seen that in the use of my fur individual lining cup, in the breast supporting cup portion of a brassiere, that my individual fur cup is loosely placed within the breast supporting pocket of the brassiere, before the brassiere is strap 25 fastened onto the feminine body, and then the brassiere is so fastened with the cup in place, with the fur side of my inner lining cup being adjacent to the feminine breast, as diagrammatically shown in FIGS. 2 and 4. FIG. 2 cup illustrates by a cut away edge part the inward fur hair extension side thereof. The brassiere pressure against the feminine breast, with my novel fur lining as explained first placed loosely within the breast supporting cup, acts to hold my unattached fur lining cup within the brassiere breast cup and against the feminine breast during such use, with that fur extending normally about ¼ to ⅜ inches from its hide side, creates a comfortable friction-free pressure for the wearer by the brassiere cup having such lining fur side against the feminine breast, on such brassiere use fastening of the brassiere by the body strap.

Another preferred best mode, of my novel individual unattached fur cup linings for each brassiere supporting cup, is illustrated in my FIGS. 3, 4, and 5, as used with a conventional shoulder strap type feminine brassiere. This modification is formed with my inner cup lining made of segments 20 of form shown in FIG. 3, having similar radius-like edges butt sewed together to form a conical-like cup 26 and with the apex of that conical cup lining formed to have a central opening 20*a* at that center.

That central opening 20*a*, on feminine wear use of my inner lining cup within a brassiere supporting cup, permits the feminine breast nipple N to extend or protrude within that opening 20*a* on such use, diagrammatically shown in FIGS. 4 and 5. Said breast nipple extension, on such wearing within that opening 20*a*, causes the feminine breast nipple thereupon to become the lining-center-holding means for holding the cup lining within the brassiere cup. It is also to be noted, with reference to this modification shown in FIGS. 3, 4, and 5, that the feminine breast nipple N so extends within the opening 20*a* upon brassiere use, explained, with my fur cup lining within the breast supporting brassiere cup pocket, and that as a result of the feminine nipple extending therein, the nipple is sufficiently free of any uncomfortable pressure friction at the nipple end, as would normally otherwise occur by the nipple rubbing against the inner side of the breast supporting cup of the brassiere 25, as that brassiere surface is held outwardly from the nipple end by my inner cup fur lining thickness of the fur of my lining, previously explained.

Also, another novel result occurs upon feminine use of my unattached fur lining brassiere cup inserts, and with each of my cups having the just explained central apex opening designed to permit the wearer's breast nipple N to extend within that opening, namely: the inner opening periphery 20*a*, of the hide side of my fur cup lining central opening, surrounding the wearer's adjacent extended nipple, occasionally contacts the neck Nn of that wearer's nipple on breast movement, caused by normal feminine body movement, which acts to cause continud such nipple extension within that cup opening and thus a continued cup centering by the nipple extension on such wearing use, just explained.

A second modification 21 of my novel fur-like cup for loose insert lining within the breast spporting cup pocket of a plunge-type brassiere, is illustrated in my FIG. 6, as in use with such a plunge-type shoulder-strapless brassiere 40, as diagrammatically illustrated in dotted lines as inner cups 30 thereof. Such cup lining modificiation is formed preferably of only two segments, being otherwise similarly radially segmental butt edge sewed together, of fur construction as previously explained, except that in forming the shape of this fur lining brassiere cup I eliminate about the upper 40% of the otherwise conical fur cup at its upper edge. Those fur pieces or two segmens 30 are pre-cut before such sewing to form an upper half circle central opening 31 adapted to receive the feminine breast nipple N within the opening 31, with the segments butt joined for such brassiere wear lining use as illustrated in FIG. 6. The pressure of the brassiere body strap 40 of that type brassiere snugly around the feminine chest just below the breast acts to hold my such individual unattached inner fur linings 30 each in place in an adjacent brassiere cup during such plunge-type brassiere use, as diagrammatically shown in FIG. 6.

It will be seen, in thus forming my novel fur unattached lining fur cups of subtantially conical shape, as illustrated and heretofore explained, that the shape of the resultant cup, in butt sewing the arc segment chord-radius segments edges together, as at 10*a* of FIG. 2, will be controlled by the outer edge arc measurement of each arc segment in the pre-forming by the shape cutting of each fur segment 10*b* or 20*b*. Each such segment 10*b* and 20*b* measurement, as illustrated in FIGS. 1, 2 and 3, measures substantially 110° arc of a circle at its outer arc edge, to thus thereby form an average-size conical lining brassiere cup member. For a more acute or extended conical resultant shape of such cup lining, such arc measurement of the peripheral or arc distance of each such segments would be pre-sewed shaped with a measurement of less than such 110° measurement of a circle before those segmental arcs are butt sewed together. And, for a shallower resultant cup-like fur cup lining conical shape, each such fur arc segment would be cut before sewing assembly with a peripheral arc measurement greater than such 110° arc measurement, but not to exceed a maximum of 120° in the case of three such arc segments. Each such segmental arc distance measurement is in terms of the peripheral arc segmental periphery, whether its outer edge is crescent shape, straight or otherwise shaped, as such outer peripheral edge could be of different design configuration than as the arc of a circle to form the substantially conical cone when sewed assembled, as illustrated, as for example, same could be cut to form a resultant triangular-like outer edge otherwise conical cone shaped lining, if desired.

It should be noted that one of my fur lining best mode modifications, illustrated in FIGS. 3, 4 and 5 has the apex central opening 20*a* therein with that central opening inner peripheral edge being about one-half inch inner diameter designed to closely surround the protruded neck-like portion of the feminine breast nipple extending therein, on brassiere wear use with my novel lining therein, as explained, and that said protruded feminine nipple neck Nn acts as a lining center-holding means for causing the centerholding of the adjacent inner fur brassiere cup lining in place within its adjacent individual brassiere supporting cup on the feminine body, as explained.

While I speak of my individual fur-like inner lining cups as brassiere cup linings, within each brassiere breast supporting cup, 10 or 20 or 30, as being unattachedly positioned within the breast supporting cups of the brassiere, it is to be understood that my such individual novel fur linings could be permanently attached as such fur lining within a conventional brassiere cup, if desired within the teaching of this invention.

Having thus explained the construction of several preferred embodiments of my invention, it is understood that many other changes and modifications may be made therein without deviating from the spirit, purpose, intent and teaching hereof, and therefore, I wish to be bound only by the hereunto appended claims.

I claim:

1. In combination with a brassiere clothing garment for feminine wear having individual breast supporting cups, a body chest holding strap and a shoulder strap, the combination therewith of a separate fur-like material conical-like individual inner lining cup having a hide outer surface and a fur inner surface, with each lining cup adapted to be unattachedly positioned within a breast supporting cup of the brassiere, whereby upon feminine breast body wearing of the brassiere, by the brassiere securement to a feminine chest by the chest strap and with a fur lining cup in each brassiere cup, the fur-lined inserts cups will each be pressure held within its adjacent brassiere breast cup by the brassiere body securement pressure against the feminine breast.

2. The combination with a feminine brassiere garment of a fur-lined inner cup within each of its breast supporting cups as defined in preceding claim 1, and further defined by said fur lining cups being formed with a conical apex central opening, whereby upon breast wearing of the brassiere and the breast having a nipple and with said fur-lined individual cup within each brassiere breast supporting cup the feminine breast nipple of the wearer will extend within its said fur inner lining apex opening, and the neck portion of that feminine breast nipple so extending in that opening comprising center-holding means for holding of its said brassiere lining cup within its brassiere breast supporting cup.

3. The combination with a feminine brassiere garment as defind in preceding claim 2 and further defined with said inner fur lining cup being low cut formed of a shape to conform with a plunge-type brassiere shape brassiere cup of less than a complete conical cups.

4. In combination, a feminine brassiere undergarment having a body holding strap adapted to secure it to a feminine breasted body, an overshoulder strap supporting portion and having individual breast supporting cups formed therein, and individual fur lining cups each having a fur hair side and each of configuration to conform with the shape of an adjacent inner breast supporting cup of the brassiere and each adapted upon feminine wear to be unattachedly inserted within a brassiere cup and to be breast pressure secured therein upon brassiere securement to the feminine body; with said fur lining cups each being formed of natural soft fur with the fur hair side positioned on the inner side thereof, whereby upon feminine wearing of the brassiere with the lining cups therein said fur side will be in contact with the feminine breast, and whereby a feminine breast will comprise pressure holding means for holding its adjacent lining cup within its adjacent brassiere cup upon feminine brassiere wear with said lining cup therein upon body strap brassiere securement on the feminine body.

5. In a feminine brassiere undergarment as defined in preceding claim 4, and further defined by the fur cup lining so in each breast supporting cup having a central opening formed therein adapted to permit the feminine breast nipple to extend in the adjacent cup lining opening, upon a wearing of the brassiere on the feminine body, for nipple center-holding of the adjacent cup lining within that adjacent brassiere cup during such brassiere and cup lining feminine wear.

* * * * *